United States Patent [19]

Horowitz

[11] 4,444,454

[45] Apr. 24, 1984

[54] FIELD INSTALLABLE COAXIAL PLUG CONNECTOR

[75] Inventor: Alan I. Horowitz, Windsor Locks, Conn.

[73] Assignee: Hi-G Incorporated, Windsor Locks, Conn.

[21] Appl. No.: 417,331

[22] Filed: Sep. 13, 1982

[51] Int. Cl.[3] ..... H01R 17/18

[52] U.S. Cl. ..... 339/177 R; 339/179

[58] Field of Search ..... 339/177–179

[56] References Cited

U.S. PATENT DOCUMENTS

| | | | |
|---|---|---|---|
| 3,001,169 | 9/1961 | Blonder | 339/177 R |
| 3,074,045 | 1/1963 | Overholser | 339/177 R |
| 3,199,061 | 8/1965 | Johnson et al. | 339/177 R |
| 3,453,376 | 7/1969 | Ziegler et al. | 339/177 R |
| 3,551,882 | 12/1970 | O'Keefe | 339/177 E |
| 3,671,926 | 6/1972 | Nepovim | 339/177 E |
| 3,744,011 | 7/1973 | Blanchenot | 339/177 R |
| 3,818,120 | 6/1974 | Spinner | 339/177 E |

OTHER PUBLICATIONS

"Stepped Coaxial Transition Fixture", Brader et al., Western Elec., Tech. Dig. #32, (10/73), pp. 13–14.

*Primary Examiner*—Joseph H. McGlynn
*Assistant Examiner*—David L. Pirlot
*Attorney, Agent, or Firm*—Hayes & Reinsmith

[57] ABSTRACT

A plug connector is disclosed which is particularly useful with a coaxial cable having alternating layers of braided shield and foil tape between an outer insulating plastic jacket and an inner dielectric covering a center conductor. The connector has a housing, with an internally threaded end having a predetermined thread pitch for manual "twist-on" connection to the outer plastic jacket of the cable, and a center contact having an internally threaded opening with a thread pitch different from that of the end of the housing. The center contact of the connector is designed to require greater "twist-on" torque, to effect a good connection to the center cable conductor, than that torque required to effect assembly of the connector housing and cable jacket.

9 Claims, 3 Drawing Figures

FIELD INSTALLABLE COAXIAL PLUG CONNECTOR

FIELD OF THE INVENTION

This invention generally concerns a field installable coaxial plug connector and particularly concerns a manual twist-on type connector of a type which is readily reusable.

BACKGROUND OF THE INVENTION

A variety of connector devices for providing an electrical connection for coaxial cables are presently available for different forms of cable.

Such connectors are, however, largely limited to specialized, relatively complex connectors which may be field installable or to customized connectors requiring use of special crimping tools and which cannot be used in any subsequent applications in the absence of significant modifications or structural changes being made to the connector devices.

Examples of types of known connectors which are customized to provide electrical contact with a coaxial cable center conductor are disclosed in Swedish Pat. No. 185,621 and U.S. Pat. No. 3,601,766 dated Aug. 24, 1971, entitled "Connector Device for Supporting Cables and For Additionally Providing an Electrical Connection" and issued in the name of Vernon F. Alibert.

Moreover, cable connectors in the known art have been particularly difficult to assemble and have frequently required use of specialized assembly tools. Cable connectors of a type illustrated in the referenced U.S. Pat. No. 3,601,766 are directed to maintaining an electrical contact and mechanical connection between the cable and a downstream use device and normally utilize a specialized connector component structure to achieve such a connection.

SUMMARY OF THE INVENTION

This invention discloses a simplified coaxial cable plug connector which not only eliminates need or use of any specialized tools during assembly of the coaxial cable and connector device but also automatically provides a connection between the connector device and coaxial cable of high electrical and mechanical integrity. Assembly may be made by one of minimum skill while yet providing a coaxial cable connection highly resistant to vibration, abuse and mishandling. Moreover, the plug connector is particularly suited to be reused in a subsequent coaxial cable application. In addition, the connector of this invention may even be used with specialized cables and provides requisite electrical connection and mechanical support without any unintended dislodgement of various layers of the elements of the coaxial cable. A particularly unique feature of this invention is provided by the utilization of a predetermined thread pitch for a center contact connection of the connector device to the center conductor of the cable which is different from the pitch of the threaded connection of an internally threaded portion of the connector housing and outer coaxial cable jacket.

Other objects will be in part obvious and in part pointed out in more detail hereinafter.

A better understanding of the objects, advantages, features, properties and relations of the invention will be obtained from the following detailed description and accompanying drawings which sets forth an illustrative embodiment and are indicative of the way in which the principle of this invention is employed.

DESCRIPTION OF A PREFERRED EMBODIMENT

Figure 1:
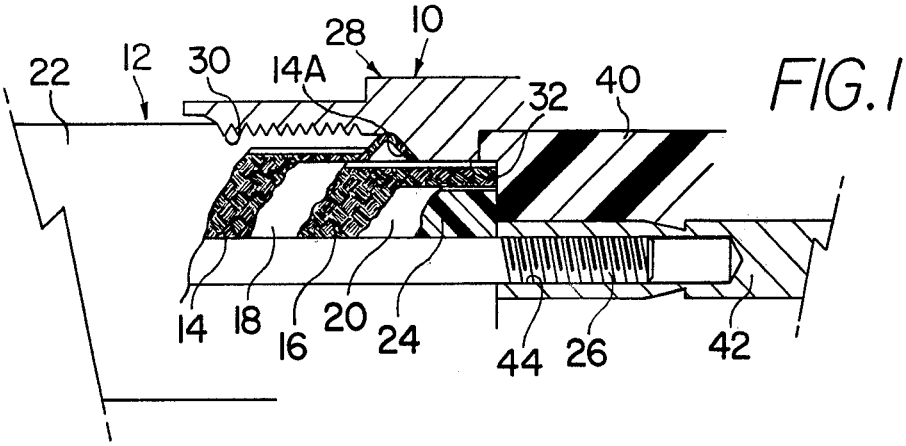
FIG. 1 shows a connector device of this invention in combination with a coaxial cable, the view being partly broken away and partly in section.
Figure 2:
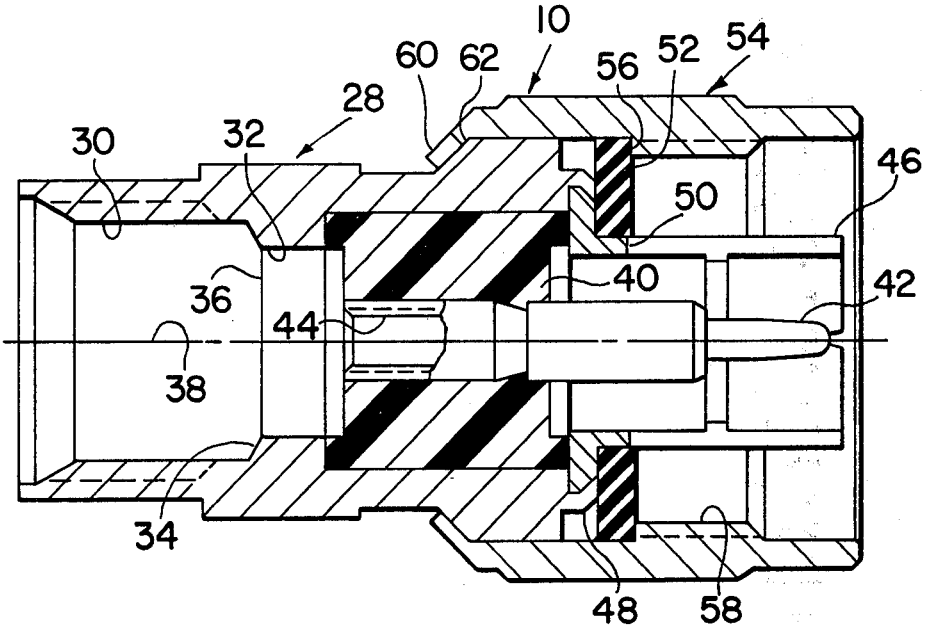
FIG. 2 is a view, partly in section, showing certain features of the connector of FIG. 1.
Figure 3:
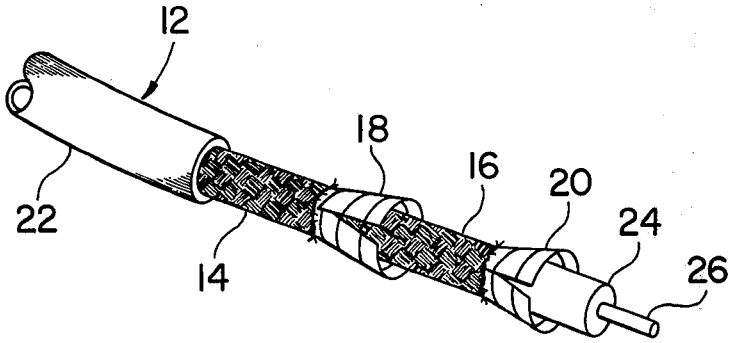
FIG. 3 illustrates a partially cut-away perspective view of the cable of FIG. 1.

Referring to the drawings in detail, a connector device 10 is illustrated as being secured to a coaxial cable 12. The latter is provided with alternating layers of braided shield 14 and 16 and foil tape 18 and 20 between an extruded outer insulating plastic jacket 22 and an inner core dielectric 24 covering a center conductor 26.

More specifically, the outer plastic jacket 22 of cable 12 may be formed of polyvinyl chloride or other plastic jacketing of suitable insulating material comprising an outer sheath for cable 12. Outer braid 14 is provided of woven tinned copper or other suitable electrically conducting material providing an inner sheath. The second inner sheath of woven tinned copper braid 16 is illustrated as being coaxially interposed between layers of electrically conducting foil tape 18 and 20 formed of aluminum or its equivalent which, in turn, are respectively coaxially interposed between outer and inner tinned copper braid layers 14, 16 and between the inner sheath 16 of tinned copper braid and core dielectric 24.

To provide a suitable inner insulator coating, the core dielectric 24 is preferably formed of cellular or foam polyethylene insulation in circumferentially surrounding relation to center conductor 26 which may be a solid tinned copper or other suitable electrically conducting material.

As illustrated, the coaxial cable 12 is preferably assembled with its center conductor 26 being exposed at one cable end to protrude a preselected distance beyond its core dielectric 24. The coaxial cable 12 is also illustrated as having its outer PVC jacket stripped back a predetermined distance to expose outer sheath 14 of woven tinned copper braid over a predetermined axial distance along the cable.

The connector device 10 of this invention is particularly suited to provide a good electrical connection between an outer cylindrical housing 28 of the connector 10 and outer sheath 14 of woven tinned copper braid. More specifically, housing 28 is formed of brass or equivalent material of electrical conductivity and mechanical strength. Housing 28 has an upstream internally threaded end 30 of a predetermined, preferably uniform pitch. The internal major diameter of the connector housing threads is less than the external major cable diameter of jacket 22.

In accordance with this invention, the connector housing 28 has a necked down internal intermediate portion 32 of minimum diameter which joins the internally threaded end 30 of housing 28 by a juncture defined by an angled shoulder 34 which extends at an angle of about 30° to a radially extending plane containing an upstream end 36 of the necked down internal intermediate portion 32 of housing 28, which plane is perpendicular to the longitudinally extending axis 38 of housing 28. The internal shoulder 34, so formed as disclosed, provides a grounding shoulder for good electrical connection to a terminal end 14A of outer sheath 14 of woven tinned copper braid which is exposed, as noted above, by stripping back the PVC jacket 22 of cable 12.

By virtue of such construction, housing 28 of connector 10 may be assembled simply by manually twisting it onto the jacketed cable 12. Exposed outer braid 14 is automatically pushed back and compressed against internal grounding shoulder 34 of housing 28 by the extruded cable jacket 22. Housing 28 is dimensioned at its necked down internal intermediate portion 32 to wipe the outer foil layer 18 without effecting surface distortion or compression. The internal grounding shoulder 34 of housing 28 coacts with the cable jacket 22 to fold back the outer cable braid 14 to provide good connection. Jacket 22 in turn cold flows into the interstices of the internal housing threads to effect a solid threaded mechanical connection between the outer insulating jacket 22 and end of housing 28, the inner layers of foil tape 18, 20 and inner woven tinned copper braid 16 being substantially undisturbed.

During assembly of connector 10 to cable 12, an insert 40, preferably formed of Dupont "Teflon" insulating material or other suitable insulating material, which is carried by housing 28 is driven into surrounding relation to a center contact 42 of connector 10 and into fixed abutment with end faces of the coaxial cable layers of foil 18, inner sheath of woven tinned copper braid 16, foil 20 and core dielectric 24.

Center contact 42 of connector 10 is preferably initially manually twisted onto the externally protruding exposed end of center conductor 26 of the coaxial cable 12 prior to the above described twist-on assembly of the housing 28 to the cable 12. In accordance with another feature of this invention, the center contact 42 is provided with an elongated threaded end opening 44 having a preferably uniform thread pitch which is intentionally designed to be different from that of the threaded opening 30 of the housing 28. During installation, contact 42 is simply twisted onto conductor 26 and self-threads its outer surface in a secure mechanical fashion until a positive engagement is achieved upon the annular end shoulder of the contact 42 abutting the core dielectric 24. The center contact 42 will be understood to be formed of a suitable electrically conducting material such as brass and is of a predetermined length to project beyond insulating insert 40 in an axially centered installed position within the housing 28. Contact 42 when installed is coaxially aligned relative to coaxial cable 12 which is to be connected by housing 28 to a downstream end use device, not shown. More specifically and in view of the materials forming jacket 22 and conductor 26, the thread pitch of center contact 42 is so chosen as to require greater torque during assembly than that required by self-threading the housing 28 onto jacket 22, thereby assuring a connection to conductor 26 of enhanced electrical and mechanical integrity.

Housing 28 further includes a split sleeve 46 centrally mounted within housing 28 to project in circumferentially surrounding spaced coaxial relation to center contact 42. Sleeve 46 is secured to housing 28 by an inwardly turned annular ring 48 formed on a downstream end of housing 28 to fix a radially outwardly extending end collar 50 of split sleeve 46. An insulating silicone rubber gasket 52 is fitted between split sleeve 46 and a cylindrical coupling 54 which is rotatably mounted on cable connector housing 28 in coaxially aligned relation. Coupling 54 may be formed of the same material of which housing 28 is made. Silicone rubber gasket 52 is suitably axially fixed against radially extending collar 50 of split sleeve 46 by an internal shoulder 56 of an internally threaded portion 58 of minimum diameter formed on an inside wall of coupling 54. For retaining the coupling 54 on housing 28 against unintended axial displacement while permitting coupling 54 to rotate relative to housing 28 for suitable connection to a downstream use device, the coupling 54 has an upstream external annular end 60 deformed radially inwardly into contact engagement with an angled shoulder 62 of housing 28.

Such construction provides a solid threaded connection not only between connector housing 28 and outer jacket 22 of coaxial cable 12 but additionally between cable center conductor 26 and connector center contact 42 which, as described above, has a thread pitch which is intentionally different from that of the connector housing threaded end 30. Such construction assures an improved electrical and mechanical connection of high integrity between coaxial cable 12 and connector 10 which fixes two relatively isolated and separated cable components, namely, the outermost jacket 22 and innermost conductor 26 by mechanical connections of different thread pitch for added strength of the mechanical attachment. During such quick and easy "twist-on" assembly which is readily made by an unskilled operator, insulated insert 40 is driven rearwardly, as housing 28 is threaded onto the cable jacket, and into direct contact engagement with the exposed end of the coaxial cable 12 to provide a firm mechanical abutment between components. Internal grounding shoulder 34 of housing 28 effects a good electrical connection between the outer sheath 14 of woven tinned copper braid and the connector housing 28 and the disclosed dual threaded attachment of differential thread pitch of the connector 10 to the coaxial cable center conductor 26 and the coaxial cable outer jacket 22 effects a prealigned assembly of connected parts which heretofore has required a significantly greater deal of experience on the part of a technician, frequently with special tools and crimping, which are all totally eliminated by the disclosed connector construction. Moreover, it will be seen that the connector of this invention may be reused upon disassembly with another coaxial cable. In addition, the entire connector unit is field installable for maximum convenience of use.

As will be apparent to persons skilled in the art, various modifications, adaptations and variations of the foregoing specific disclosure can be made without departing from the teaching of this invention.

I claim:

1. In combination, a coaxial cable having coaxially arranged layers of shield between an outer insulating jacket and an inner dielectric covering a center conductor, and a cable connector including a cylindrical housing having an internally threaded end opening with a predetermined thread pitch to be manually threaded onto the outside of the jacket in a twist-on assembly, and a center contact having an internally threaded end opening with a preselected thread pitch different from the thread pitch of the internally threaded end opening of the housing, the center contact being manually threaded onto the outside of the center conductor in a twist-on attachment, thereby to provide a dual threaded connection to the coaxial cable of high electrical and mechanical integrity.

2. The combination of claim 1 wherein the cable connector housing includes an internal annular grounding shoulder engageable with an outer shield layer, the internal annular grounding shoulder being configured and dimensioned such that upon manually twisting the housing onto the jacket to make a threaded connection by cold flow of the outer insulating jacket into the interstices of the internally threaded end opening of the housing, the inner layers of shield are substantially undisturbed.

3. The combination of claim 2 wherein the housing includes a necked down internal intermediate portion which merges with the annular grounding shoulder, the necked down internal intermediate portion being configured and dimensioned to wipe a second shield layer which is in direct underlying relation to said outer shield layer, and to leave undisturbed each of the shield layers underlying said outer shield layer, the internal grounding shoulder coacting with the outer cable jacket during twist-on assembly in folding back said outer shield layer into direct contact engagement with the internal annular grounding shoulder of the housing.

4. The combination of claim 1 wherein the connector center contact is separable from the housing and is independently installed by said twist-on attachment to the center conductor before twist-on assembly of the connector housing to the outer cable jacket.

5. The combination of claim 1 or 4 wherein the thread pitch of the internally threaded end opening of the connector center contact is preselected to require a predetermined torque during its twist-on attachment to the cable center conductor for good electrical connection, said predetermined torque being greater than that required by the thread pitch of the internally threaded end opening of the housing during twist-on assembly of the connector housing to the outer cable jacket.

6. The combination of claim 5 wherein the connector center contact includes an annular end shoulder surrounding its internally threaded end opening, said end shoulder being driven into fixed abutting engagement with the dielectric of the cable during twist-on attachment of the center contact to the center conductor.

7. The combination of claim 1 or 2 wherein the connector includes a hollow insulating end insert fixed within the housing for receiving the cable center conductor and the connector center contact threadably secured thereon, and a use device coupling rotatably mounted on the connector housing in coaxially aligned relation thereto.

8. The combination of claim 7 wherein upon completion of said twist-on assembly of the connector housing to the outer cable jacket, said insulating end insert is engaged with ends of the dielectric and the coaxial cable shields underlying said outer shield layer.

9. The combination of claim 7 wherein the housing includes a centrally aligned split sleeve mounted on the housing to project therefrom in circumferentially surrounding spaced coaxial relation to the center contact, the split sleeve being received within the confines of the coupling which is in circumferentially surrounding spaced coaxial relation to the split sleeve.

* * * * *